US005428901A

United States Patent [19]

Slates

[11] Patent Number: 5,428,901

[45] Date of Patent: Jul. 4, 1995

[54] BOW SIGHT MOUNT

[75] Inventor: Scott O. Slates, Wentzville, Mo.

[73] Assignee: Toxonics Manufacturing, Inc., Wentzville, Mo.

[21] Appl. No.: 233,753

[22] Filed: Apr. 26, 1994

[51] Int. Cl.[6] ..... F41G 1/467

[52] U.S. Cl. ..... 33/265; 124/87

[58] Field of Search ..... 33/265, 241; 124/87

[56] References Cited

U.S. PATENT DOCUMENTS

| | | | |
|---|---|---|---|
| 2,982,026 | 5/1961 | Peterson | 33/265 |
| 3,475,820 | 11/1969 | Kernan | 33/265 |
| 3,696,517 | 10/1972 | Larson | 33/265 |
| 3,849,894 | 11/1974 | Broughman | 33/265 |
| 4,136,461 | 1/1979 | Gasser | 33/265 |
| 4,317,288 | 3/1982 | Yasui | 33/265 |
| 4,584,777 | 4/1986 | Saunders | 33/265 |
| 4,697,350 | 10/1987 | Shepley et al. | 33/265 |
| 5,050,576 | 9/1991 | Larson | 33/265 |
| 5,303,479 | 4/1994 | Rudovsky | 33/265 |
| 5,341,791 | 8/1994 | Shafer | 33/265 |

*Primary Examiner*—Thomas B. Will
*Attorney, Agent, or Firm*—Paul M. Denk

[57] ABSTRACT

A mount for a bow hunting sight includes a mounting block and an extension arm. The mounting block has a threaded screw hole and at least one elongate groove extending across the block. The extension includes a hole which is alignable with the hole in said mounting block and a projection matable with the groove in the mounting block. The hole has a beveled edge. A screw extends through the extension arm hole into the mounting block screw hole to removably secure the extension arm to the mounting block. The screw having a head having a beveled surface at the bottom thereof mates with the beveled edge of the extension arm hole. The interaction of the beveled surfaces of the screw head with the beveled surface surrounding the arm hole and the interaction of the arm projections with the mounting plate grooves provides that the arm, and hence the sight, can be easily mounted to the bow in an aligned position, i.e., the sight will not have to be aligned once it is secured to the bow.

6 Claims, 1 Drawing Sheet

BOW SIGHT MOUNT

BACKGROUND OF THE INVENTION

This invention relates to hunting bows, and, in particular, to a mount for a hunting bow sight.

Hunting bow sights are provided with a number of pins which enable the hunter to aim his bow for a particular distance. A hunter may use several hunting bow sights, each having a different number of pins, or a different configuration of pins corresponding to different distances. Thus, a hunter may use one sight for closer range targets and another sight for longer range targets.

For the hunting sight to operate properly, it must be properly mounted on the bow. However, the sight mount typically does not allow for easy and quick attachment of the sight which is also mounts the sight so that it is substantially aligned. Because the hunter may need to quickly change his sights, the inability to quickly and accurately mount a hunting sight impedes the hunter's ability to hunt efficiently.

SUMMARY OF THE INVENTION

One object of this invention is to provide a hunting sight mount for a bow.

Another object is to provide such a mount which will enable quick and easy mounting of the sight to the bow.

Another object is to provide such a mount which will mount the sight to be substantially aligned.

These and other objects will become apparent to those skilled in the art in light of the following disclosure and accompanying drawings.

Briefly stated, a bow hunting sight mount of the present invention includes a mounting block which is secured to a bow and an extension arm which is removably secured to the mounting block. The sight is secured to the extension arm. The mounting block has a threaded screw hole generally centered with respect to the block and at least one groove. The extension arm includes a hole in a mounting end of the arm which is alignable with the hole in the mounting block and a projection mateable with the groove in the mounting block. A screw extends through the extension arm hole into the mounting block screw hole to removably secure the extension arm to said mounting block. The groove has tapered walls. The taper preferably being about 45°. The projection on the arm conforms to the shape of the groove. The extension arm has a beveled surface which surrounds its screw hole. The screw has a head having a beveled bottom. The beveled bottom of the screw head conforms to the beveled edge of the arm hole. The interaction of the screw head with the arm hole and the arm projections with the mounting block grooves provides a quick attachment of the arm to the block in such a way that the arm, and hence the sight, will be mounted such that the sight is sufficiently aligned for hunting and will not have to be aligned before use. This provides the hunter with the ability to change sights quickly and without the need to align the newly mounted sight.

DESCRIPTION OF THE PREFERRED EMBODIMENTS

Figure 1:
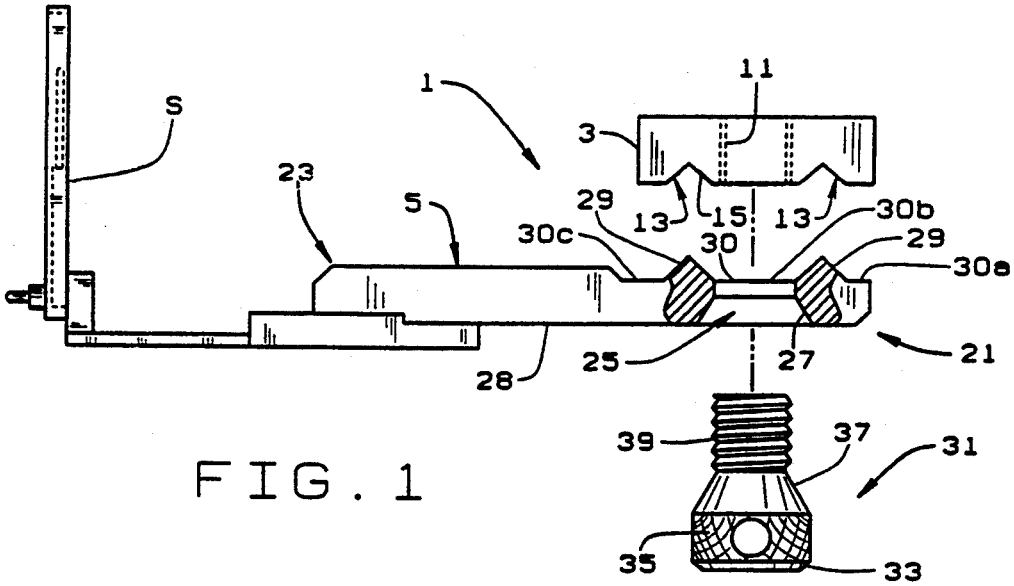
FIG. 1 is an exploded side view, partly in cross-section, of a mount of the present invention partly in cross-section.

Referring now to the FIG. 1, reference numeral 1 indicates one illustrative embodiment of a hunting sight mount of the present invention. Mount 1 includes a mounting block 3 which is secured to a bow, as is known in the art. An extension arm 5 is secured to the block 3 and holds a sight S.

Figure 2:
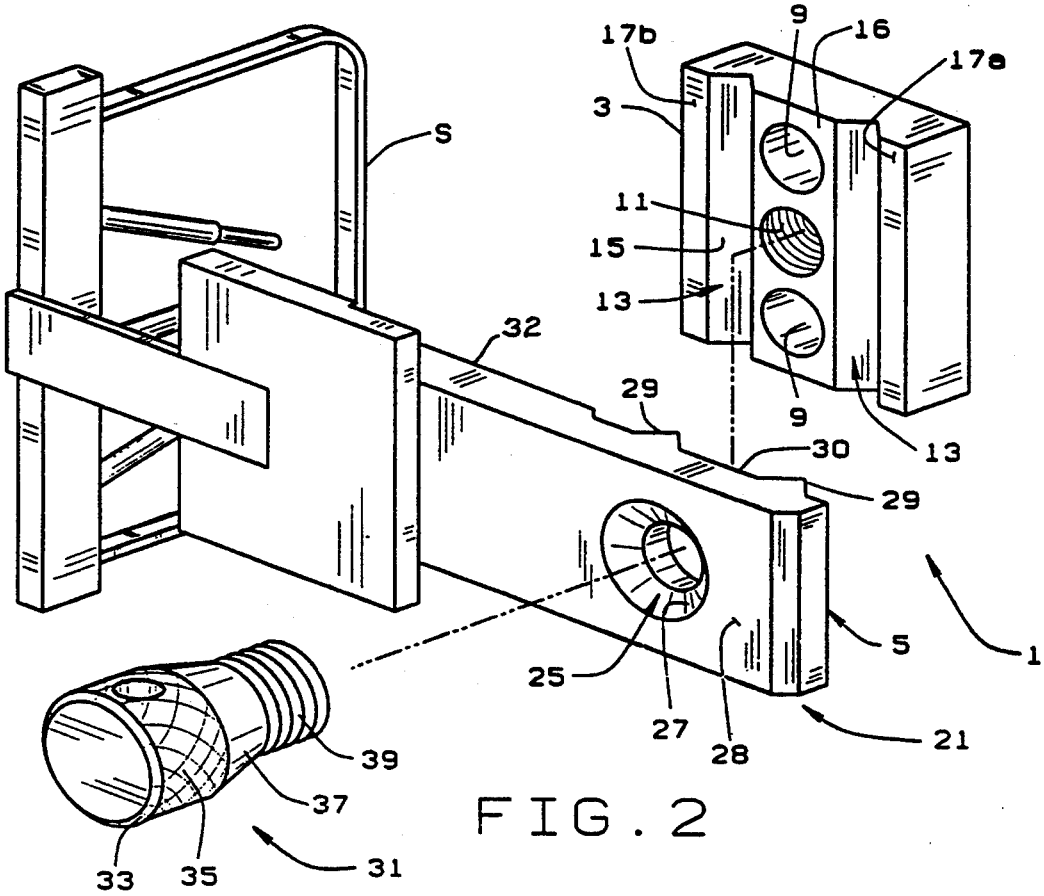
FIG. 2 is an exploded perspective view of the mount.

Block 3 includes a pair of screw holes 9 through which screws or the like are passed to secure the block to the bow. A third screw hole 11 is positioned between holes 9. Holes 9 and 11 are preferably arranged in a vertical relationship. Grooves 13 are formed on either side of hole 11. Grooves 13 preferably extend vertically, as seen in FIG. 2, the full height of block 3. Grooves 13 have beveled edges 15 which are extend at an angle of 45° from the surface of block 3. The groove 13 is preferably triangular in cross-section and the edges 15 of each groove meet to form 90° angles. The grooves 13 are spaced apart by a surface 16, in which holes 9 and 11 are formed. Outer surfaces **17*a* and 17*b* are formed outwardly of grooves 13. Surfaces 17*a* and 17*b*** are generally co-planar.

Extension arm 5 has a mounting end 21 and a sight end 23 distal from end 21. Sight S is secured to end 23 of arm 5. An opening 25 is formed in mounting end 21. Beveled edges 27 are formed around the outer edges of opening 25 on an outer surface 28 of arm 5. Edges 27 preferably form an angle of about 30° with the outer surface 28 of arm 5. Triangular projections 29 extend outwardly from the inner surface 30 of arm 5. Inner surface 30 consists of three parts, an outer part **30*a*, a middle part 30*b*, and an inner part 30*c*, all of which are substantially co-planar. Arm 5 widens at 32 between surfaces 30*c* and sight end 23**.

When the arm 5 is mounted to block 1, hole 25 is aligned with hole 11 and the projections 29 are fitted in the grooves 13. Arm surfaces **30*a*, 30*b*, and 30*c* fit on block surfaces 17*a*, 16 and 17*b*, respectively. It is just as likely that the projections 29 could be formed extending from the surface 16 of the block 3, and, in addition, the grooves 13 and 15 could be provided aligned upon the arm 5. A screw 31 is passed through hole 25 into hole 11 to hold the arm 5 to block 3. Screw 31 includes a head 33 having a knurled outer surface 35. Below surface 35, head 33 has a beveled or sloped surface 37 which mates with the surface 27 of opening 25. A threaded shaft 39 of the screw extends downwardly from the surface 37**.

When the arm is secured to the block with the screw, the screw head surface 37 interacts with the beveled surface 27 of screw hole 25 to secure the extension arm vertically on the block 3. The projections 21 mate with the grooves to secure the extension arm from left to right or horizontally on the block 3. Thus, the structure of the block 3 and arm 5 allow the arm to be quickly secured to the block so that it will be aligned. To ensure that the quick attachment of the arm will mount the sight so that it is properly aligned, the block must be properly attached to the bow. However, once that step is performed, the quick attachment feature of this mount will mount the sight so that it is substantially aligned.

Variations within the scope of the appended claims may be apparent to those skilled in the art. For example, the grooves could extend vertically, rather than horizontally. Both horizontal and vertical grooves and projections could be supplied. These variations are merely illustrative.

I claim:

1. A mount for a bow hunting sight including:

a mounting block which is secured to a bow, said mounting block having a threaded screw hole generally centered with respect to said block and at least one groove;

an extension arm which is removably secured to the block at one end, said sight being mounted to said extension arm at an end distal from said end mounting to said block, said extension arm including a hole in said mounting end which is alignable with the hole in said mounting block and a projection mateable with the groove in said mounting block;

a screw which extends through said extension arm hole into said mounting block screw hole to removably secure said extension arm to said mounting block;

said groove extending vertically along said mounting block, and wherein said groove has tapered walls, said walls being tapered at approximately 45°.

2. The mount of claim 1 wherein there are two grooves formed in said mounting block and two projections formed in said extension arm, said grooves and said projections being formed on opposite sides of the holes.

3. The mount of claim 1 wherein said extension arm has a first surface and a second surface, the hole in said extension arm extending between said surfaces, said hole having a beveled edge, said beveled edge being adjacent said first surface.

4. The mount of claim 3 wherein said screw has a head, said head having a top and a side, said side being beveled at the bottom thereof, said beveled edge of said screw head mating with the beveled edge of said extension arm hole.

5. A mount for a bow hunting sight including:

a mounting block which is secured to a bow, said mounting block having a threaded screw hole generally centered with respect to said block and at least one elongate groove extending across said block;

an extension arm which is removably secured to the block at one end, said sight being mounted to said extension arm at an end distal from said mounting end, said extension arm including a hole in said mounting end which is alignable with the hole in said mounting block and a projection mateable with the groove in said mounting block, said hole having a beveled edge;

a screw which extends through said extension arm hole into said mounting block screw hole to removably secure said extension arm to said mounting block, said screw having a head, said head having a top and a side, said side being beveled at the bottom thereof, said beveled edge of said screw head mating with the beveled edge of said extension arm hole, said groove extending vertically along said mounting block, and said groove having tapered walls, with said walls being tapered at approximately 45°.

6. The mount of claim 5 wherein there are two grooves formed in said mounting block and two projections formed in said extension arm, said grooves and said projections being formed on opposite sides of the holes.

* * * * *